United States Patent [19]

Rooker

[11] Patent Number: 4,911,729

[45] Date of Patent: Mar. 27, 1990

[54] OVERBURDEN ELIMINATOR ROCK DRILL BIT

[76] Inventor: Robert E. Rooker, Rte. 1, Box 68, Linwood, Kans. 66052

[21] Appl. No.: 396,867

[22] Filed: Aug. 22, 1989

Related U.S. Application Data

[63] Continuation-in-part of Ser. No. 258,755, Jan. 13, 1989, abandoned.

[51] Int. Cl.[4] ..... E21B 10/36

[52] U.S. Cl. ..... 175/393; 175/415; 175/418

[58] Field of Search ..... 175/393, 408, 414, 415, 175/417, 418, 389, 396, 401, 323

[56] References Cited

U.S. PATENT DOCUMENTS

| | | | |
|---|---|---|---|
| 2,696,973 | 2/1951 | Baumgartner | 175/323 |
| 2,733,943 | 2/1956 | Nater | 175/323 |
| 2,776,819 | 1/1957 | Brown . | |
| 2,879,973 | 3/1959 | Saxman . | |
| 3,194,331 | 7/1965 | Arnold | 175/323 |
| 3,605,925 | 9/1969 | Berscheid . | |
| 3,945,446 | 3/1976 | Ostertag et al. | 175/323 |
| 4,049,066 | 9/1977 | Richey | 175/323 |
| 4,385,669 | 5/1983 | Knutsen | 175/323 |

*Primary Examiner*—Jerome W. Massie
*Assistant Examiner*—Terry Lee Melius

[57] ABSTRACT

An improved overburden eliminator rock drill bit (10) is provided which includes a cylindrical body (12), cutting inserts (14) mounted thereon, and squared grooves (16) formed along the length of body (12) in a vertically tapered fashion. The taper of grooves (16) is counterclockwise in slope when viewed from the top, i.e. as viewed from above rearward end (20). Cutting face (22) engages overburden as cutting edges (30) cut overburden material so that it may be blown upwardly along grooves (16) by fluid pressure exerted through openings (32). The taper of grooves (16) serves to facilitate the upward migration of overburden material during the counter clockwise rotary action of bit (10).

3 Claims, 3 Drawing Sheets

OVERBURDEN ELIMINATOR ROCK DRILL BIT

The present application is a continuation-in-part of copending U.S. patent filed Jan. 13, 1989, Ser. No. 07/258,755 now abandoned.

BACKGROUND OF THE INVENTION

1. Field of the Invention

This invention relates to a rock drill bit advantageously designed to allow efficient cutting and removal of both overburden and rock formations. More particularly, it is concerned with a drill bit having a cylindrical body of uniform diameter with vertically tapered, squared grooves formed thereon.

2. Description of the Prior Art

It is well known that laying pipe in a rock formation presents particular problems. Initially, the rock must be broken into a composition that can be effectively removed by a back-hoe machine. This reduction is accomplished by dynamite. A wagon drill is used to create holes for such dynamite blasting. The wagon drill utilizes a rock drill bit presenting an X-type formation of four carbide cutters, on the bottom thereof, for chipping the rock. Often, one air hole is provided between each of the carbide cutters near the outside of the bit as well as one air hole in the center of the bottom of the bit, for a total of five holes, for blowing out the rock cuttings.

In the conventional drill bits, the carbide cutters extend radially past the periphery of the bit about 1/16 of an inch. The upper two thirds portion of the bit body is smaller than the lower one third portion. Substantially vertical portions about the periphery of the body are cut out to allow the cuttings to be blown up past the bit and out of the hole.

The problem with this design is that it does not deal effectively with overburden (i.e. dirt, mud, clay, shale, sandstone, etc., disposed above the rock formation). When the conventional drill bit is used in a formation containing overburden, the bit does not adequately bore through same. The bit simply pushes the overburden to the side and up over the top of the bit, so that it "collars-up" on (i.e. closes in around) the drill pipe thereby shutting off the hole and preventing the wagon drill from functioning properly. The air holes often become plugged with this overburden and the drill bit may be difficult, if not impossible, to retract from the hole. What is needed is a drill bit which adequately deals with the cutting and elimination of overburden. A number of rock drill bits have been utilized in the past. Patents illustrating these prior units include: U.S. Pat. Nos. 4,385,669, 4,049,066, 3,945,446, 3,605,925, 2,696,973.

SUMMARY OF THE INVENTION

The problems outlined above are in large measure solved by the rock drill bit in accordance with the present invention. That is to say, the bit hereof is designed to cut rock efficiently, yet also cut and dispose of overburden. The rock drill bit in accordance with the present invention broadly includes a cylindrical, radially uniform body having forward and rearward ends, structure affixed on the rearward end for connecting the bit to a wagon drill, squared grooves formed in a vertically tapered fashion along the periphery of the body and cutting inserts mounted on the forward end. The squared grooves are all vertically tapered in the same orientation so as to facilitate rotary cutting action of the forward end of the bit.

In particularly preferred forms, the bit includes a plurality of openings for directing drilling fluid to the forward end thereof. The openings are located proximal to the intersection of the body and the forward end.

DESCRIPTION OF THE PREFERRED EMBODIMENT

A wagon drill is often used for drilling holes in rock for the purpose of inserting dynamite sticks. Such a wagon drill will normally utilize a rock drill bit which is connected to the drill by a drill string.

Figure 1:
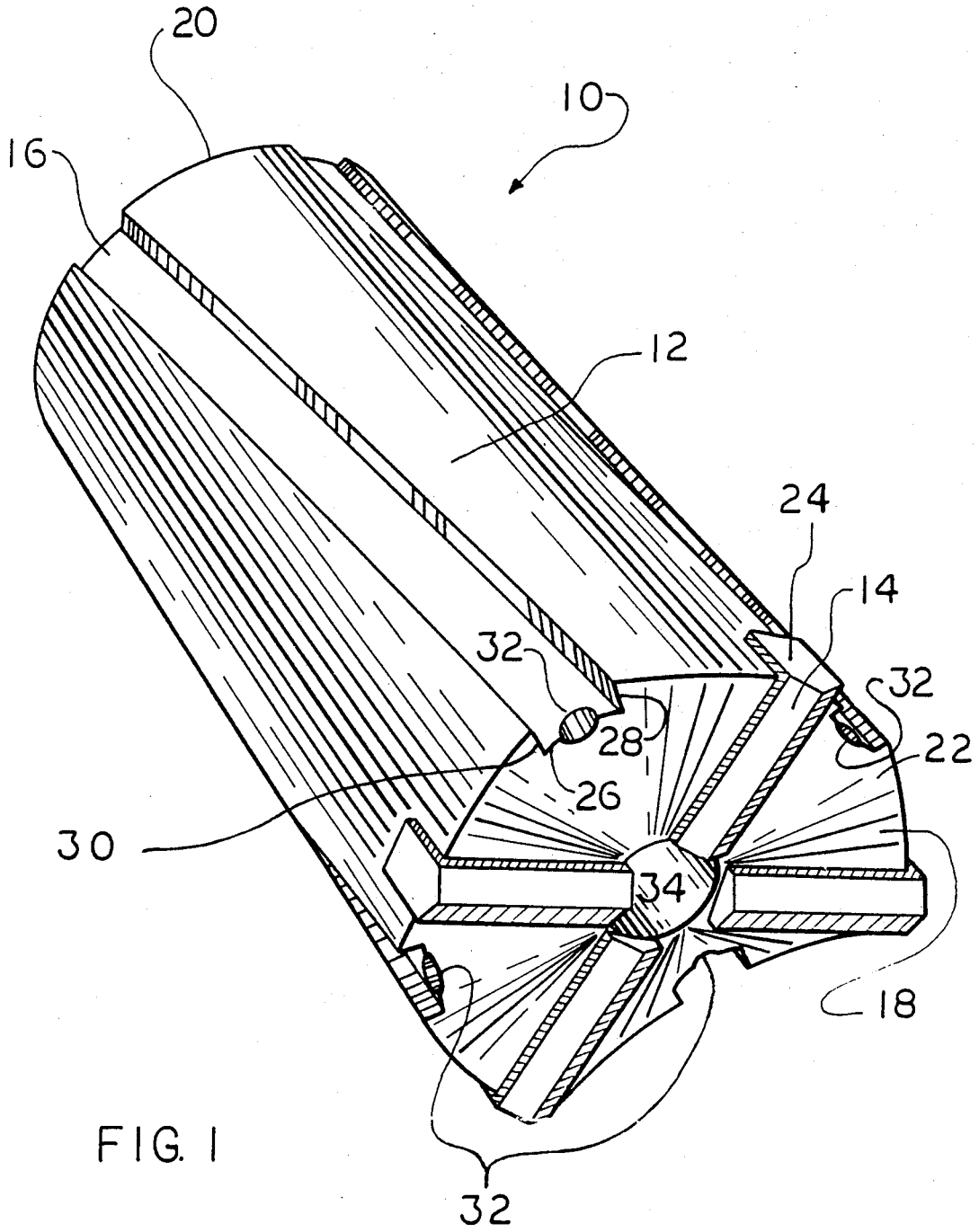
FIG. 1 is a perspective view of the preferred embodiment of the overburden eliminator rock drill bit in accordance with the present invention.

Referring now to the drawing in general and FIG. 1 in particular, an overburden eliminator rock drill bit 10 (also known as a rotary percussion rock-drill bit or, more simply, drill bit) in accordance with the invention broadly includes a body 12, cutting inserts 14 and squared grooves 16. Inserts 14 are used for mashing and cutting rock, while grooves 16 are used for cutting and removing overburden (such as dirt, mud, clay, shale, sandstone, etc.) and removing rock.

Cylindrical body 12 can be made of any suitably hard and durable material satisfactory for cutting rock. Body 12 presents a forward end 18 and a rearward end 20 (which includes connecting structure suitable for connecting a drill). Forward end 18 defines a cutting face 22. Body 12 includes a plurality of axially aligned, internal, generally centralized bores (not shown) spanning the vertical length thereof. The radial dimension of body 12 is substantially the same from rearward end 20 to forward end 18.

Carbide cutting inserts 14 are mountingly engaged on cutting face 22 so as to present an X-type pattern. Each insert 14 includes a portion 24 radially extending beyond the outer periphery of body 12 approximately 1/16 of an inch.

Figure 2:
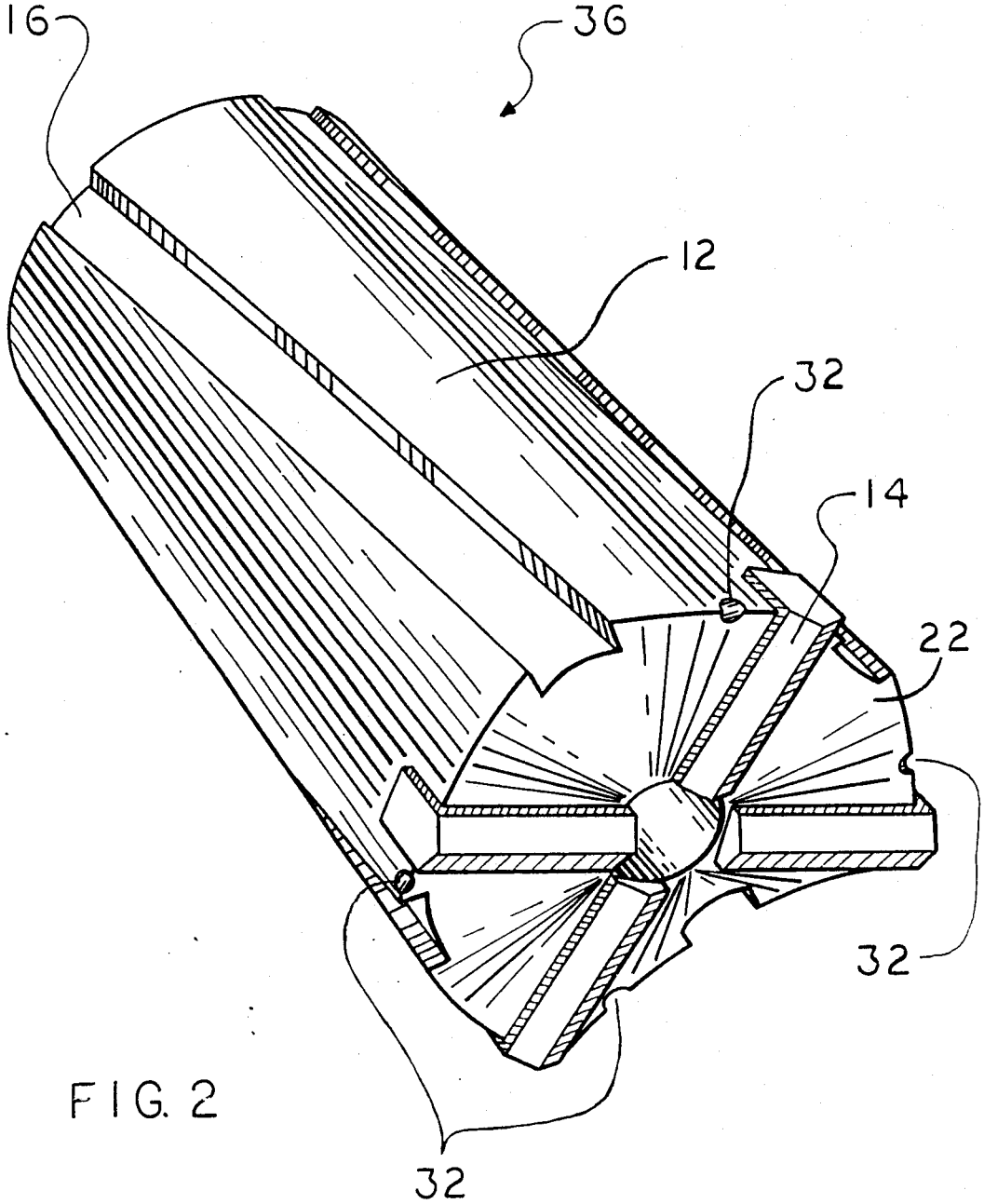
FIG. 2 is a perspective view of another embodiment of the rock drill bit.
Figure 3:
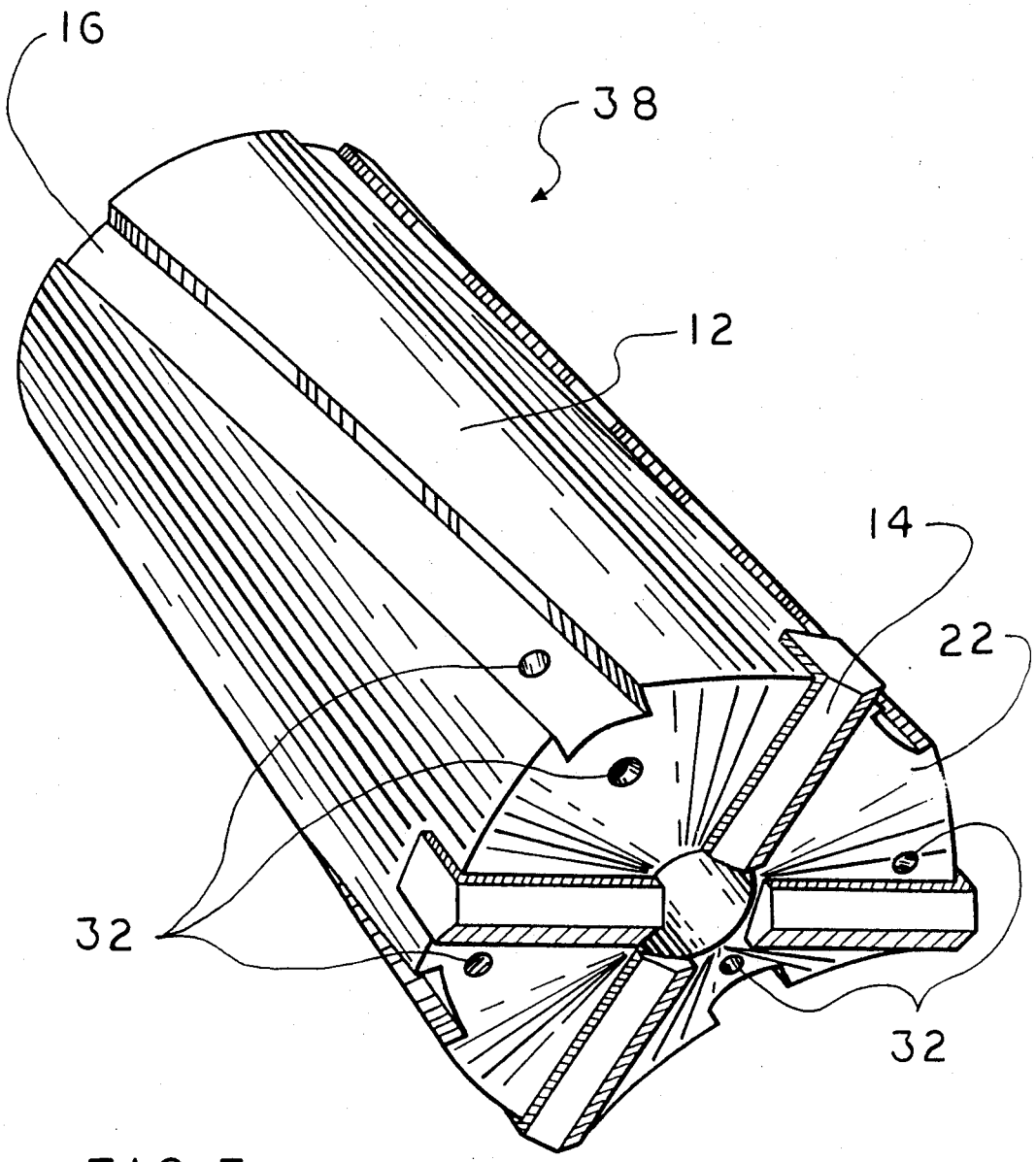
FIG. 3 is yet another embodiment of the present invention.

Squared grooves 16 are substantially squared in cross section with the dimension of bight 26 being approximately ¾ of an inch and forward edge 28 and rearward or cutting edge 30 each being approximately ¼ of an inch in depth. Although grooves 16 are substantially vertical, that is to say axial in orientation, there is a slight taper in a counter clockwise direction as viewed from the top of the bit (i.e. looking down toward rearward end 20). Rearward edge or cutting edge 30 presents a cutting surface to be discussed in detail below. Openings 32 are formed at the intersection of grooves 16 and cutting face 22, (i.e. along bights 26). Openings 32 define the lowermost terminal point of and are in fluid communication with the bores running substantially the length of body 12. Those skilled in the art will readily appreciate that openings 32 can be located at other points proximal to the intersection of body 12 and cutting edge 22 (as depicted in FIGS. 2 and 3). Of course, in the alternative embodiments the configuration of the bores is adjusted accordingly so as to be in fluid communication with openings 32. Central opening 34 is provided as shown.

As an additional option, a horizontal groove having a bight approximately ¾ of an inch and approximately ¼ inch deep may be formed half way up the body 12.

In operation, drill bit 10 is fastened with the connecting structure to the drill string of a wagon drill. The drill bit 10 is then addressed over the area to be drilled and the rotary percussion action of drill bit 10 is then employed in a counterclockwise fashion as viewed from above. If there is no overburden, (i.e. substantially pure rock is to be drilled), the drill bit 10 of the present invention will perform in substantially the same fashion as the prior arts. However, if overburden is encountered, the drill bit 10 of the present invention will exhibit superior performance in the following way.

Inserts 14 achieve a mashing and cutting action on the overburden as cutting edge 30 begins to cut same. Those skilled in the art will readily appreciate that the cutting edge is optimally situated for the cutting of such soft material in a counter clockwise fashion as viewed from overhead. As overburden is cut by cutting edges 30 it is forced upwardly into squared grooves 16 by the blowing action of air emerging from openings 32. Of course, other fluids such as water may be used in substitution or in combination with pressurized air. The tapered geometry of grooves 16 in combination with the counterclockwise rotary action facilitates the upward migration of cut overburden. In the embodiment featuring an additional horizonal groove disposed about the middle of body 12, additional breakup of overburden can be accomplished at that site.

The advantageous combination of the cylindrical geometry of body 12 with the tapered geometry of grooves 16 results in a much more efficient drilling of overburden. For example, there is no "collaring up" of overburden above drill bit 10, in that grooves 16 span the entire length of drill bit 10 as opposed to prior art where grooves typically only extend up one third of the body length). Also, since the upward motion of the material is facilitated by the taper of grooves 16 the material is ejected upwardly from rearward end 20 with greater velocity so that the drilling hole is more effectively cleaned by air pressure during the drilling process.

As a result of these improvements, drilling using the present invention is more efficient and less time consuming. With the prior art, the bit must be run up and down repeatedly, increasing the depth of the hole an inch or so each time in order to prevent collaring up. For example, in one experimental use a prior art drill bit was used in an area having approximately 6 to 12 feet of overburden. Only 400 drill feet was achieved per eight hour day. However, when the drill bit 10 of the present invention was used in the same area over 1000 drill feet was achieved in just 4½ hours. Hence, great savings in labor are achieved with the present invention, not to mention the reduced wear and tear on machinery and reduced fuel costs.

Openings 32 may also be located at other points proximal to the intersection of body 12 and cutting face. For example, those skilled in the art will readily appreciate that drill bit 36 of FIG. 2, using openings 32 located at the intersection of body 12 and cutting face 22 at points other than in grooves 16, and drill bit 38 of FIG. 3 using openings 32 located in grooves 16 or on cutting face 22 will achieve similar results to that of drill bit 10 in FIG. 1.

I claim:

1. A rotary percussion rock-drill bit for use in eliminating overburden during drilling comprising:

a cylindrical body having an outer periphery, a forward end defining a cutting face and a rearward end, said cylindrical body having a substantially uniform diameter from the forward end to the rearward end;

means located at said rearward end for connecting said bit to a drill string;

a plurality of cutting inserts mounted on said cutting face, said cutting inserts extending radially outwardly from said cylindrical body;

a plurality of squared grooves formed on the cylindrical body, said grooves extending the entire length of said cylindrical body and sloping slightly in the direction of rotation from the forward end to the rearward end of said cylindrical body, said grooves intersecting said cutting face of said cylindrical body between pairs of said plurality of cutting inserts, said grooves further including a cutting edge on a rearward side, with respect to the direction of rotation of the bit, for cutting overburden; and a plurality of openings for directing drilling fluid to the cutting face of the cylindrical body and to the squared grooves, said openings being located proximal to the intersection of said outer periphery of said cylindrical body and said cutting face.

2. The rotary percussion rock drill bit as set forth in claim 1, further comprising:

a central fluid opening for directing drilling fluid to the cutting face of said cylindrical body.

3. The rotary percussion rock-drill bit as set forth in claim 1, said openings being located at the intersection of said grooves with said cutting face.

* * * * *